United States Patent [19]

Parise

[11] 4,009,728

[45] Mar. 1, 1977

[54] WATER VALVE ASSEMBLY

[75] Inventor: Carl Parise, Reno, Nev.

[73] Assignee: Parise & Sons, Inc., Reno, Nev.

[22] Filed: Mar. 9, 1976

[21] Appl. No.: 665,218

[52] U.S. Cl. ..... 137/594; 15/321; 137/343

[51] Int. Cl.[2] ..... A47L 9/24

[58] Field of Search ..... 15/321, 322, 345, 346; 137/343, 594

[56] References Cited

UNITED STATES PATENTS 3,079,285 2/1963 Rockwell ..... 15/321 X

*Primary Examiner*—Alan Cohan
*Assistant Examiner*—Gerald A. Michalsky
*Attorney, Agent, or Firm*—Sughrue, Rothwell, Mion, Zinn & Macpeak

[57] ABSTRACT

A water valve assembly for mounting on the vacuum return wand of a steam cleaner a water valve of the type having an outwardly biased actuating member which prevents the passage of water in its normal position and permits the passage of water when pressed inwardly. The assembly comprises (a) two mating mounting brackets shaped to receive portions of the peripheries of the vacuum return wand and the water valve, (b) a shaft passing through the mounting brackets between the vacuum return wand and the water valve, (c) a lever arm mounted on shaft between the two mounting brackets, and (d) means for urging the two mounting brackets together so as to firmly grasp the vacuum return wand and the water valve therebetween.

6 Claims, 5 Drawing Figures

FIG. 3
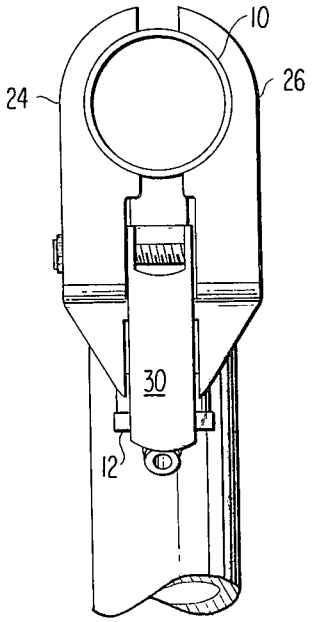
FIG. 4
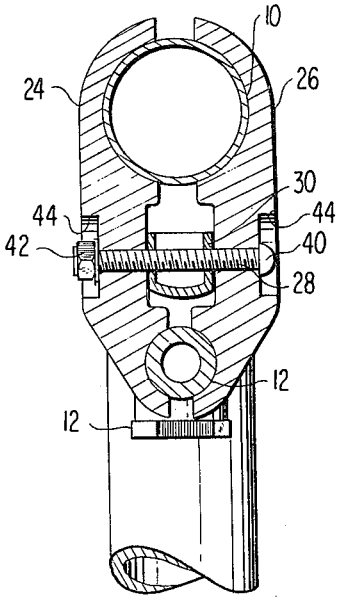
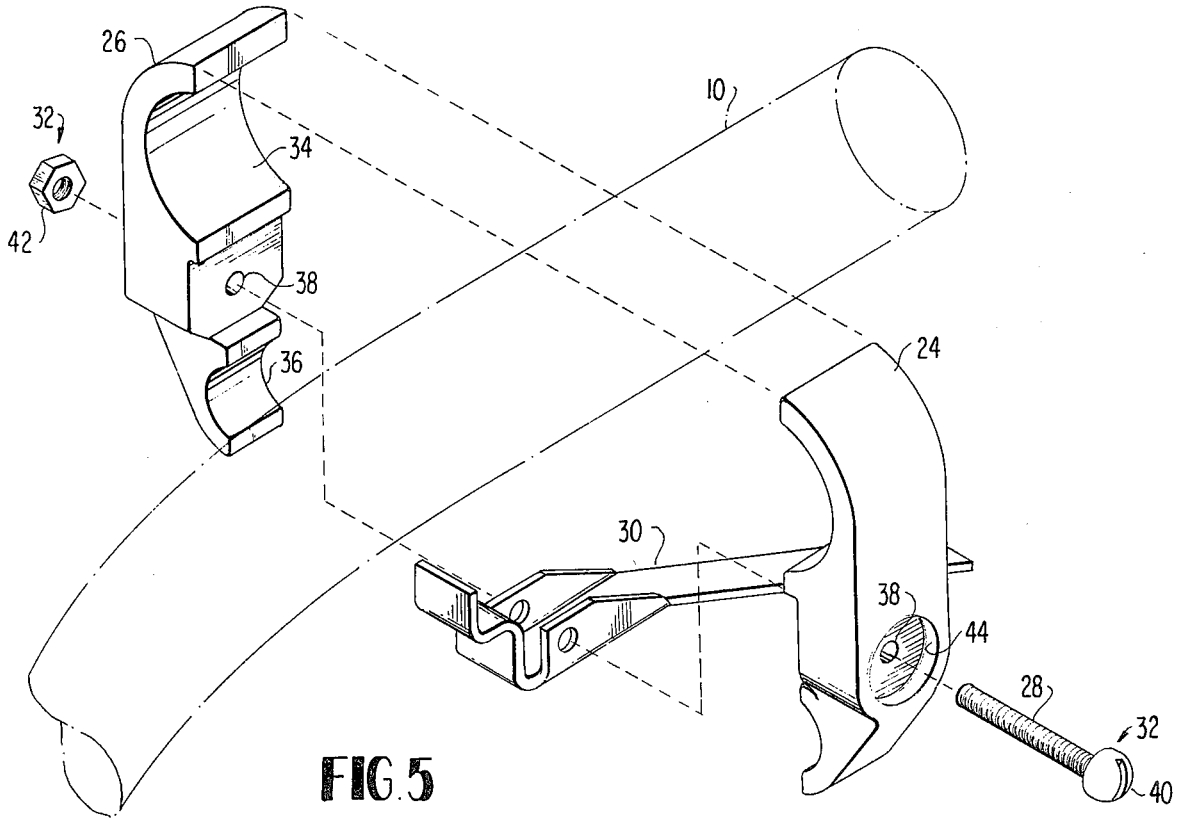
FIG. 5

WATER VALVE ASSEMBLY

FIELD OF THE INVENTION

This invention relates to what are conventionally called "steam cleaners," but which are cleaners which in fact generally cause atomized, detergent-containing hot water, rather than steam, to be sprayed on objects, such as rugs and other floor surfaces, to be cleaned. The hot water is then re-collected into a dump bucket by means of a vacuum return wand. The present invention is of an improved assembly for mounting on the vacuum return wand of such a steam cleaner a water valve of the type having an outwardly biased actuating member which prevents the passage of water in its normal position and permits the passage of water when pressed inwardly.

Steam cleaners of the type involved herein are shown, for example, in commonly assigned U.S. Pat. Nos. 3,896,521 and 3,911,524, the former of which shows the assembly previously used by the assignee of this application.

SUMMARY OF THE INVENTION

The subject water valve assembly comprises (a) two mating mounting brackets shaped to receive portions of the peripheries of a vacuum return wand and a water valve, (b) a shaft passing through the mounting brackets between the vacuum return wand and the water valve, (c) a lever arm mounted on the shaft between the two mounting brackets, and (d) means for urging the two mounting brackets together so as to firmly grasp the vacuum return wand and the water valve therebetween.

BRIEF DESCRIPTION OF THE DRAWINGS

FIG. 3 is a view along the lines 3—3 in FIG. 2.

FIG. 4 is a view along the lines 4—4 in FIG. 2.

FIG. 5 is an exploded assembly view of the subject invention.

DETAILED DESCRIPTION OF THE PREFERRED EMBODIMENT

Figure 1:
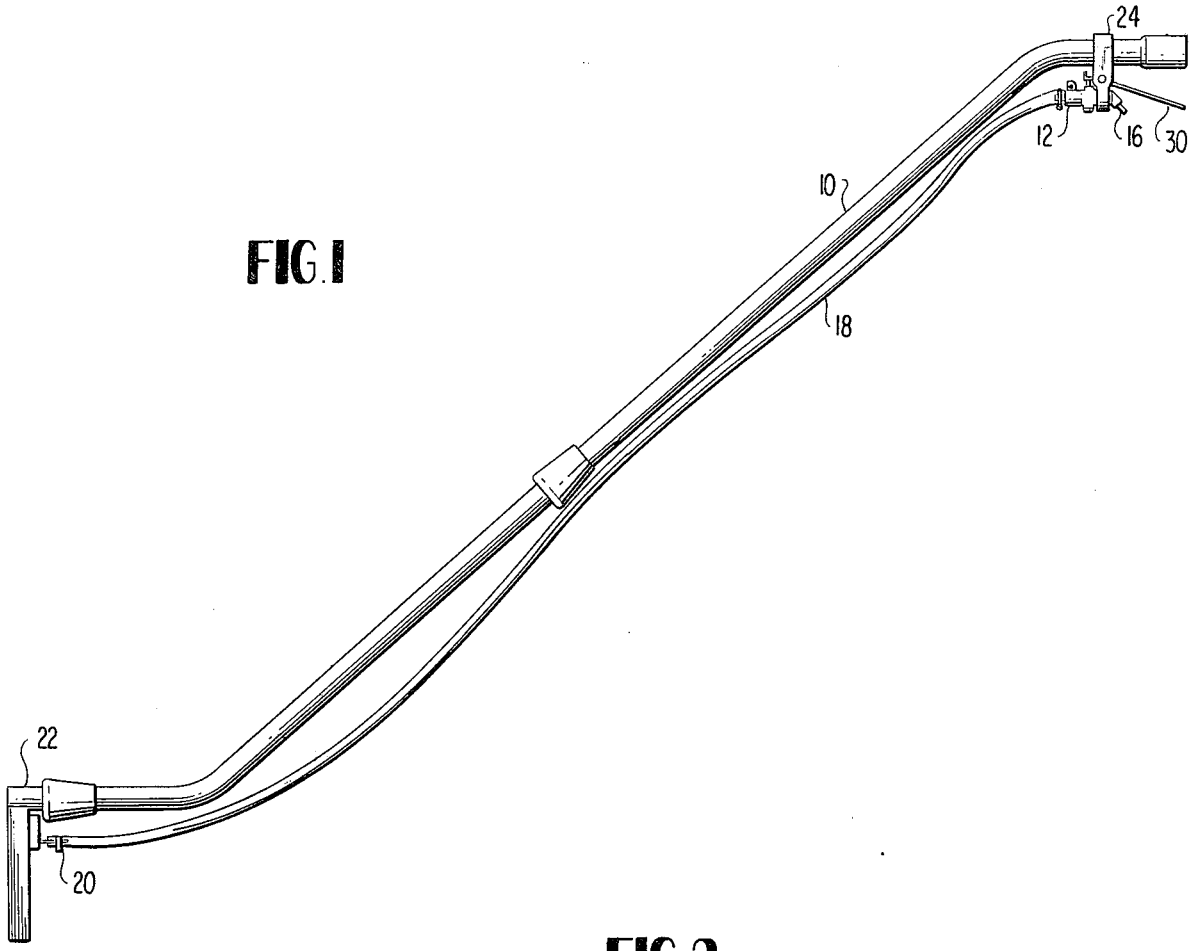
FIG. 1 is a side view of a portion of a steam cleaner employing the subject invention.
Figure 2:
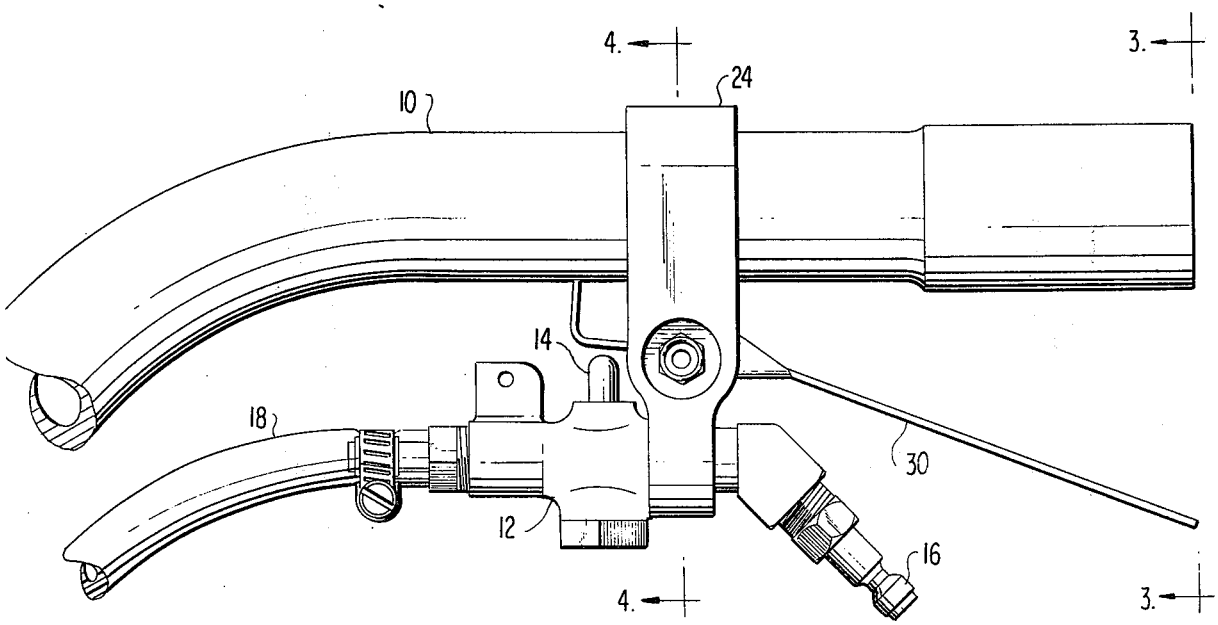
FIG. 2 is a greatly enlarged view of the portion of FIG. 1 showing the subject invention.

As best seen in FIGS. 1 and 2, the subject assembly mounts on the vacuum return wand 10 of a steam cleaner (the majority of which is not shown) a water valve 12 of the type having an outwardly biased actuating member 14 which prevents the passage of water in its normal position and permits the passage of water when pressed inwardly. A hot water line 16 leading to a hot water pump may be connected to one side of the valve 12, and a hot water line 18 leading to a spray nozzle 20 mounted on a steam cleaning head 22 may ve connected to the other side ov the valve 12.

The assembly itself comprises a first mounting bracket 24, a second mounting bracket 26, a shaft 28, a lever arm 30, and means 32 for urging the mounting brackets 24 and 26 together so as to firmly grasp the wand 10 and the valve 12 therebetween. The first and second mounting brackets 24 and 26 are preferably, but not necessarily, substantially identical. They are identical, however, in the preferred embodiment, and accordingly they will be described together.

The mounting brackets 24 and 26 each have a first concave surface 34 shaped to receive a portion of the periphery of the wand 10, a second concave surface 36 shaped to receive a portion of the periphery of the valve 12, and a hole 38 passing therethrough between the concave surfaces 34 and 36. The shaft 28, which in the preferred embodiment is the body of a bolt, passes through the holes 38, and the lever arm 30 is mounted on the shaft 28 between the mounting brackets 24 and 26. One end of the lever arm 30 is positioned to actuate the outwardly biased activating member 14 of the valve 12, and the other end of the lever arm 30 is positioned so that it can be comfortably actuated by the fingers of a hand grasping the wand 10 during use of the steam cleaner.

The shaft 28 and at least a portion of the means 32 are preferably integral. In particular, the means 32 preferably comprises the head 40 of a bolt and a nut 42 mounted on the bolt, the body of the bolt serving as the shaft 28 which passes through the holes 38. Preferably countersunk holes 44 are provided on the exterior of the mounting brackets 24 and 26 to accommodate the head 40 and the nut 42.

Preferably the lever arm 30 is pivotably mounted on the shaft 28, but the lever arm 30 could be fixedly mounted on the shaft 28. If the latter expedient were employed, the hole 38 would function as a bearing surface.

It will be observed that in the water valve assembly disclosed herein there is no direct contact between the water valve 12 and the lever arm 30 except when the lever arm 30 is actually depressing the actuating member 14. This construction greatly reduces the amount of heat transfer between the water valve 12, which can become hot enough to be unpleasant to the touch during use of the steam cleaner, and the lever arm 30. The heat transfer can be still further reduced by making the shaft 28 of a material which is a poor conductor of heat and by providing wear surfaces between the lever arm 30 and the mounting brackets 24 and 26 which are poor conductors of heat.

CAVEAT

While the present invention has been illustrated by a detailed description of a preferred embodiment thereof, it will be obvious to those skilled in the art that various changes in form and detail can be made therein without departing from the true scope of the invention. For that reason, the invention must be measured by the claims appended hereto and not by the foregoing preferred embodiment.

What is claimed is:

1. A water valve assembly for mounting on the vacuum return wand of a steam cleaner a water valve of the type having an outwardly biased actuating member which prevents the passage of water in its normal position and permits the passage of water when pressed inwardly, said assembly comprising:

a. a first mounting bracket having therein
   i. a first concave surface shaped to receive a portion of the periphery of said vacuum steam wand,
   ii. a second concave surface shaped to receive a portion of the periphery of said water valve, and
   iii. a hole passing therethrough between said first and secodnd concave surfaces;

b. a second mounting bracket having therein
   i. a first concave surface shaped to receive a portion of the periphery of said vacuum steam wand, ii. a second concave surface shaped to receive a portion of the periphery of said water valve, and iii. a hole passing therethrough between said first and second concave surfaces;

c. a shaft passing through the holes in said first and second mounting brackets;

d. a lever arm i. mounted on said shaft between said first and second mounting brackets;

ii. one end of which is positioned to actuate the outwardly biased actuating member of said water valve, and iii. the other end of which is positioned so that it can be comfortably actuated by the fingers of a hand grasping said vacuum return wand during use of said steam cleaner; and e. means for urging said first and second mounting brackets together so as to firmly grasp said vacuum return wand and said water valve therebetween.

2. A water valve assembly as claimed in claim 1 wherein said first and second mounting brackets are substantially identical.

3. A water valve assembly as claimed in claim 1 wherein said shaft and at least a portion of said means are integral.

4. A water valve assembly as claimed in claim 3 wherein said means comprises a bolt and a nut and the body of said bolt comprises said shaft.

5. A water valve assembly as claimed in claim 4 wherein countersunk holes are provided on the exterior of said mounting brackets to accommodate said nut and the head of said bolt.

6. A water valve assembly as claimed in claim 1 wherein said lever arm is pivotably mounted on said shaft.

* * * * *